US007963573B2

(12) United States Patent
Blomqvist

(10) Patent No.: US 7,963,573 B2
(45) Date of Patent: Jun. 21, 2011

(54) LOCKING DEVICE AND A METHOD OF ASSEMBLING SAME

(75) Inventor: Torbjörn Blomqvist, Lammhult (SE)

(73) Assignee: Steelform Scandianavia AB, Lammhult (SE)

( * ) Notice: Subject to any disclaimer, the term of this patent is extended or adjusted under 35 U.S.C. 154(b) by 47 days.

(21) Appl. No.: 10/570,086

(22) PCT Filed: Jun. 18, 2004

(86) PCT No.: PCT/SE2004/000982

§ 371 (c)(1),
(2), (4) Date: Mar. 1, 2006

(87) PCT Pub. No.: WO2005/024163

PCT Pub. Date: Mar. 17, 2005

(65) Prior Publication Data

US 2007/0052246 A1 Mar. 8, 2007

(30) Foreign Application Priority Data

Sep. 5, 2003 (SE) ..... 0302392

(51) Int. Cl.
*E05C 1/02* (2006.01)

(52) U.S. Cl. ..... 292/137; 292/24; 292/26; 292/39

(58) Field of Classification Search ..... 292/137, 292/156, 157, 159, 142, 4, 32, 33, 39, 57, 292/160, 24, 26, 109–110, 116–117
See application file for complete search history.

(56) References Cited

U.S. PATENT DOCUMENTS 5,722,704 A * 3/1998 Chaput et al. ..... 292/26
5,820,170 A * 10/1998 Clancy ..... 292/26
5,901,989 A * 5/1999 Becken et al. ..... 292/35
6,217,087 B1 * 4/2001 Fuller ..... 292/39
6,327,879 B1 * 12/2001 Malsom ..... 70/97
6,672,632 B1 * 1/2004 Speed et al. ..... 292/25
6,682,109 B2 * 1/2004 Horne et al. ..... 292/22
6,776,441 B2 * 8/2004 Liu ..... 292/26
7,040,671 B2 * 5/2006 Su et al. ..... 292/24
7,178,839 B2 * 2/2007 Tsai ..... 292/51

FOREIGN PATENT DOCUMENTS

DE 333932 C 3/1921
EP 1199428 A1 4/2002
WO WO 9816707 A1 4/1998

* cited by examiner

*Primary Examiner* — Carlos Lugo
*Assistant Examiner* — Mark Williams
(74) *Attorney, Agent, or Firm* — Davis & Bujold, P.L.L.C.

(57) ABSTRACT

The invention relates to a locking device at a spagnolet mechanism (1), anchored in a door or window case (39), which mechanism comprises a central adjusting mechanism (2), from which locking rods (7) originate in mutually opposite directions, the free ends of the locking rods (7) being anchored in recesses (41) in a frame (40), a locking bolt (42) being responsible for the locking, which is pivotable around a stationary revolving spindle pin (44) by the locking rods, which locking bolt (42) via a connection link (43) with joints adjacent its ends in a locking house (16) is connected to the associated locking rod. According to the invention the locking bolt (42) is partially inserted into the locking house (16) and is anchored there by way of the revolving spindle pin (44). The locking bolt is connected in an extreme outwardly pivoted position to the connection link (43) via its first joint (45) and is pivoted into the locking house jointly with connection link, which in the locking house is connected to its second joint (46) with the corresponding locking rod end, which jointly with the adjusting mechanism (2) prevent the locking bolt (42) from pivoting back to the extreme position. In this way the unity of the coupling is secured.

15 Claims, 5 Drawing Sheets

Fig. 6A
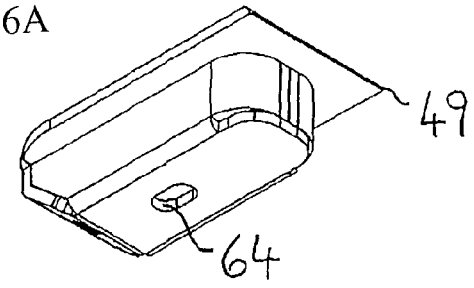
Fig. 6B
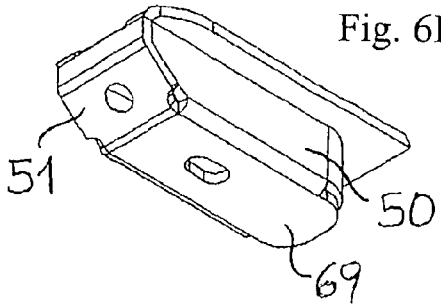
Fig. 6C
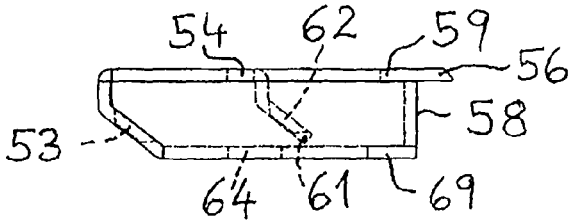
Fig. 6D
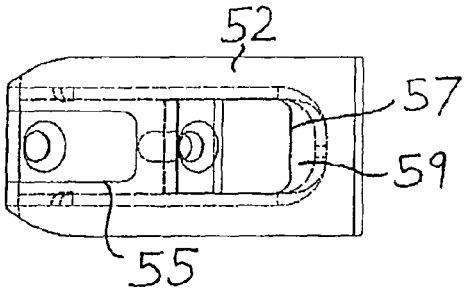
Fig. 8A
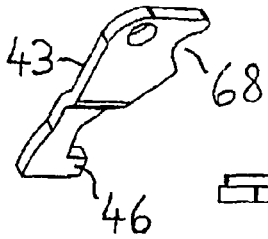
Fig. 7A
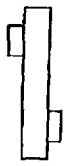
Fig. 7B
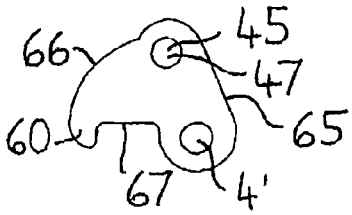
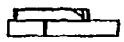
Fig. 8B
Fig. 7D
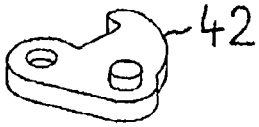
Fig. 7C
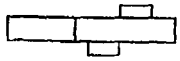
Fig. 8D
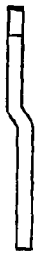
Fig. 8C
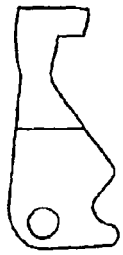

Fig. 11B
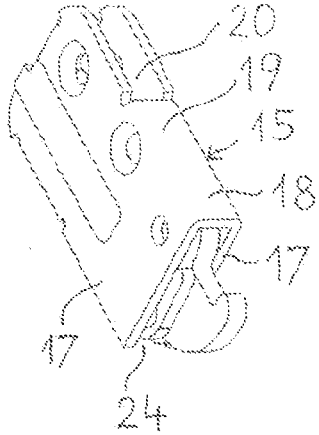
Fig. 11E
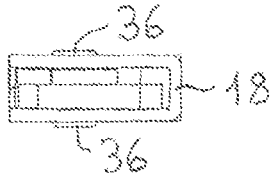
Fig. 11A
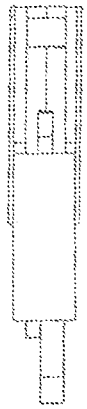
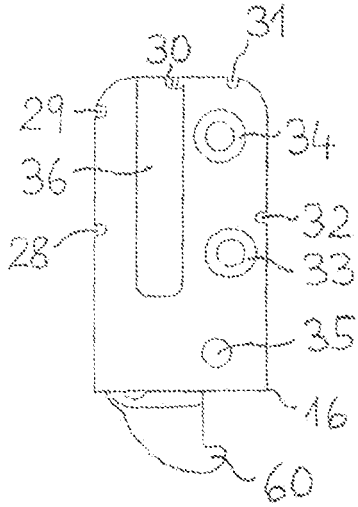
Fig. 11D
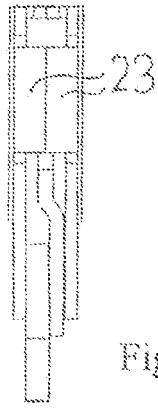
Fig. 11F
Fig. 11C
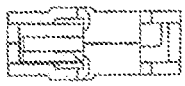
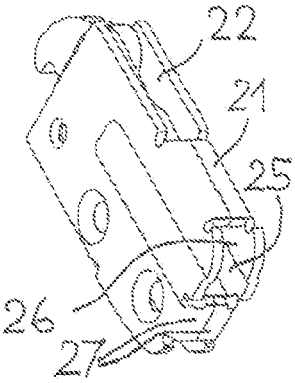
Fig. 11G

LOCKING DEVICE AND A METHOD OF ASSEMBLING SAME

This application is a national stage completion of PCT/SE2004/000982 filed Jun. 18, 2004 which claims priority from Swedish Application Serial No. 0302392-6 filed Sep. 5, 2003.

FIELD OF THE INVENTION

The present invention relates to a locking device and is described in detail in the preamble of claim 1. The invention relates also to a method of assembling such a locking device according to the preamble of the first process claim.

BACKGROUND OF THE INVENTION

Such locking devices are used in spagnolets, the central adjusting mechanism of which e.g. can correspond to the one shown and described in EP 0 932 739.

The locking rods, which mesh with the frame, have so far often been made in a simple way, i.e. with a straight locking rod end, provided with a covering and meshing in a locking position with a recess in the frame, possibly with a protective plate. However, this locking method has several drawbacks. It is e.g. not very difficult to pry the case and the frame from each other by means of burglary tools within the area of the lock rods and brake open all this unit. The locking rods are straight and offer not much resistance. Also, it is from a construction point of view not very suitable to press very long and/or strong locking rod sections into said recesses. Another drawback is, that the spagnolet mechanisms often are made in several sizes/lengths and for various purposes, i.a. different locking rod lengths being used. Especially because the locking rod ends, which face the frame, preferably will be reinforced as a protection against burglary, it has so far been advantageous to produce complete and finished spagnolet mechanisms in the factory. However, a careful planning is then necessary for large series of windows and doors respectively and a risk-taking with large stocks, since the series may often be changed.

Spagnolet mechanisms with pivotable locking rods are also known. These mechanisms are also impaired by the above-mentioned drawbacks. The locking rod is mainly straight and can, in addition to a pivoting into said recess, also be removed from it in a straight direction, e.g. when the frame and the case are pried from each other. Also, the last-mentioned mechanisms must be assembled and finished in the factory, a protective plate, which functions as a joining shell and as a mounting base for the various components, being necessary and rendering the construction heavier, expensive materials being necessary, and rendering the whole mechanism more expensive, when it is made, assembled and mounted. The assembling is carried out as follows: Subsequent to the anchoring of the central adjusting mechanism with the locking rods on the shell the locking rods are mounted with mounting holes on a spindle, anchored in the shell and then the link, which in principle is U-shaped, is inserted with its legs into mounting holes in the locking bar and the locking rod end respectively. A U-shaped house is then mounted around this joining and is anchored in the shell through upsetting, which also holds for the spindle ends. Such a joining is not designed or suitable for a loosening, but will, if necessary, be replaced with a complete new spagnolet mechanism, in case parts must be replaced. Any changes afterwards, e.g. choosing shorter or longer locking rods and then also spagnolet mechanisms, is of course impossible.

SUMMARY OF THE INVENTION

The object of the present invention is to counteract and as far as possible eliminate the above-mentioned drawbacks. Also, the invention will contribute to the development of the state of the art in this field in various additional respects.

These objects will be attained according to the invention by designing a locking device of the type set forth in the introduction, mainly in the way set forth in the characterizing clause of claim 1. Said objects are also attained by carrying out a method of the type set forth in the introduction, mainly in the way set forth in the characterizing clause of the first process claim.

BRIEF DESCRIPTION OF THE DRAWINGS

Additional characterizing features and advantages of the invention are set forth in the following description, reference being made to the accompanying drawings, which show a few preferred but not limiting embodiments. The drawings show in detail in:

FIG. 6 various views of a modified locking plate according to the invention;

FIG. 7 various views of a locking bolt according to the invention;

FIG. 8 various views of a connecting link according to the invention;

FIG. 11 various views of a frame lock according to the invention.

DETAILED DESCRIPTION OF THE INVENTION

Figure 1:
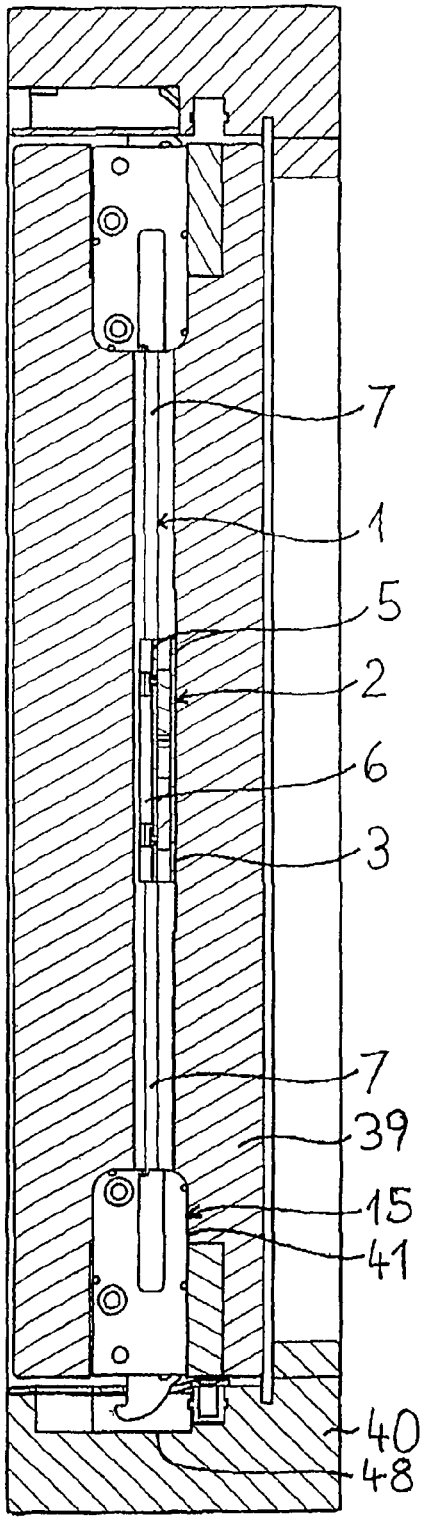
FIG. 1 a sectional planar view of a spagnolet, inserted in a window case and surrounded by a frame, with a locking device according to the invention.
Figure 2:
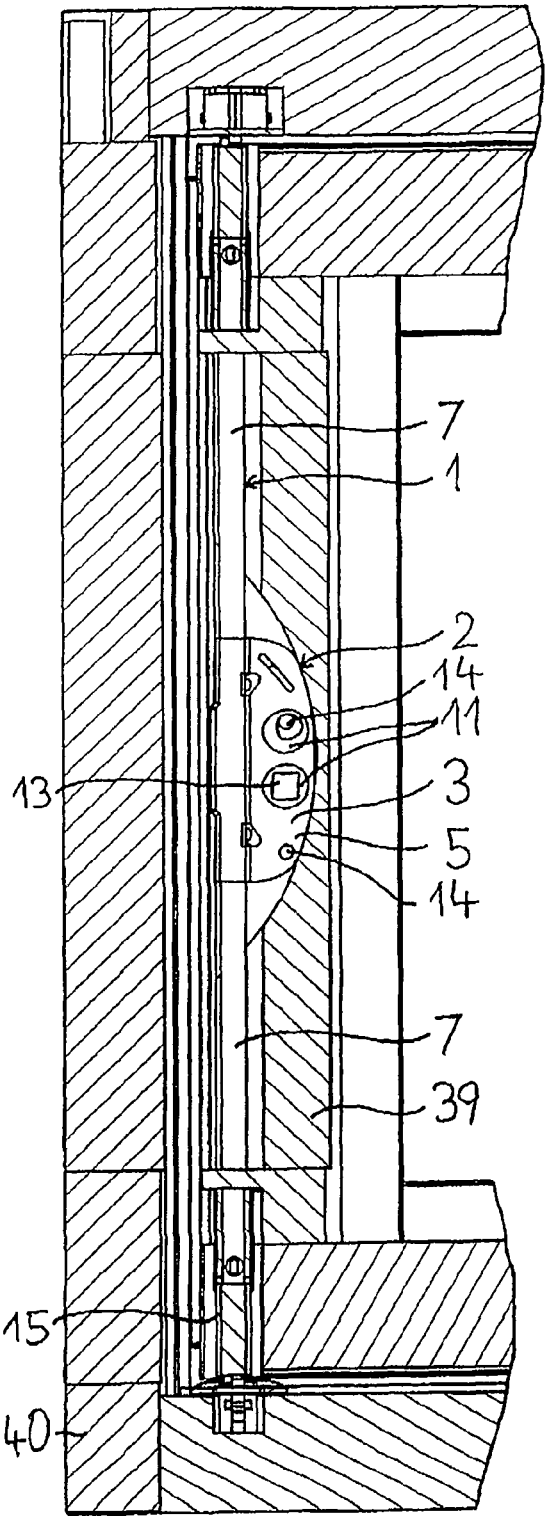
FIG. 2 a view from the left in FIG. 1.
Figure 3:
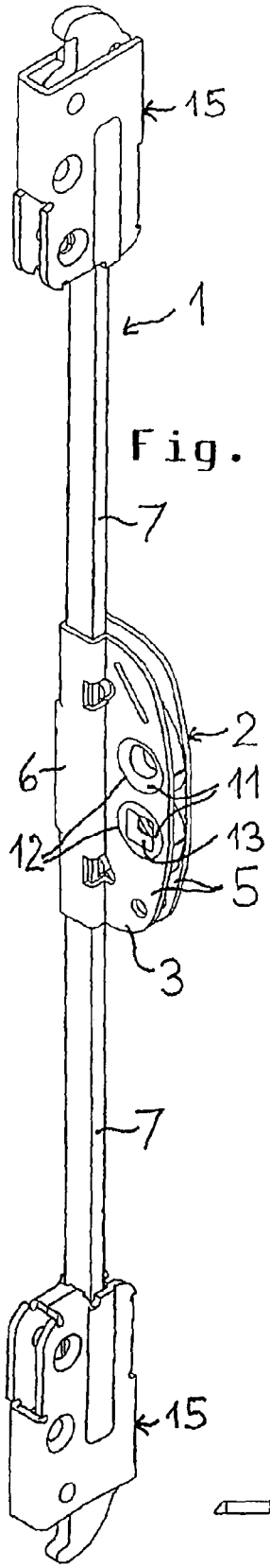
FIG. 3 a perspective view of a spagnolet with an adjusting mechanism and with locking devices according to the invention.

In the drawings a complete spagnolet 1 is shown, which includes a central adjusting mechanism 2, which includes a shell 3, comprising a doubly folded plate, between a web 4 and legs 5 of which, with a bulging 6 in one of the legs the inner ends of two in mutual opposite directions projecting locking rods 7 are guided, suitably designed as flat iron rods, and which are provided with a transverse notch 8, i.e. made in a wide side. In each notch a guide pin 9 meshes, associated with a driver 10, which with a spindle 11 is mounted in bearing bore 12 in legs 5. One of the spindles 11 is provided with a square hole 13, designed to receive a cone-shaped handle spindle (not shown). Thus, by turning the handle spindle one of said driver spindles and the driver itself are turned, which latter by means of a toothing 38 meshes with a matching toothing of second driver 10 and turns it around its spindle 10 in the opposite direction. In this way the two locking rods are simultaneously drawn into and are pushed out of respectively shell 3, which is provided with through holes 14, designed to allow a fastening in a door or window case 39, and a loosening and a locking respectively being obtained via the locking rods and by means of the spagnolet in relation to a frame 40, which surrounds said case.

The outer ends of the locking rods meshes each one with its frame lock 15, which is fastened in a recess 41 close to the frame in said case in its sides, which are facing the frame. The frame lock comprises a housing 16, made of a strong, bent plate material, roughly having a flat, elongated parallelepipedic shape, i.e. the house, which preferably consists of two symmetrical halves, has two wider main sides 17, which originate from a web 18, which extends roughly along half the length of the lock, within one of the narrow long sides 19, which has a hole 20 along its remaining portion. The other narrow long side 21 has a hole 22 opposite the web and is closed in the form of a bent web tongue 23 opposite hole 20. Gable side 24, adjacent web 18, is completely open, whereas gable side 25 roughly half of it is a hole 26, adjacent to said web tongues, and closed in the form of an end tongues 27, bent towards each other, originating from the main sides, as regards the other half of gable side 25, which preferably is transformed into said narrow long sides, designed as soft bends. Holes 20, 22 and 26 are limited by the attached bent portions 18, 23 and 27 by means of transverse notches 28, 29, 30, 31 and 32, which ensures, that the bendings will not affect the adjacent straight sections. Adjacent web 18 and hole 20 respectively the main sides are provided with crosswise through, preferably recessed bores 33 and 34 respectively, designed to receive screws or the like (not shown), anchored in the case. Also, a crosswise through bearing bore 35 is made in the corner area between gable side 24 and web 18. These three bores are mirror-symmetrically located, allowing the frame lock to be mounted in said recess with either main side 17. Finally, the main sides of the frame lock are provided with notch embossings 36, which extend along the length of the greater part of the frame lock and are closed at their ends but are open against the interior of the house and originate from that side of hole 26, which is adjacent the end tongues. These notch embossings run parallel to the web tongues and are visible from outside in the form of bulgings. They are designed to, with a limited insertion, receive the outer ends of the locking rods, which with their narrow sides are guided in the notch embossings and adjacent the end side are provided with a coupling hole 37, which runs straight through the sides and may be a round hole.

The frame lock includes also a locking bar 42 as well as a connecting link 43. The locking bar is designed to be connected to locking house 16 via a revolving spindle 44 and shares with the link a first joint 45, whereas the link is designed to, with a second joint 46, mesh with coupling hole 37 in the corresponding locking rod end. In a preferred embodiment revolving spindle 44 as well as joint 45 are located adjacent locking bar 42 in the form of one-sided spindle pins, which project in opposite directions and of which the one constituting revolving spindle 44 meshes with bearing bore 35, whereas said first joint 45 of link 43, mounted within the area of one end of the link, is designed as a bearing hole, running straight through and being designed to be pushed onto said second spindle pin 47 of the locking bar, which is a portion of said first joint. Said second joint 46 of the link, mounted at the second end of the link, is a hook, mounted transversely in relation to said bearing hole and which is designed to mesh with coupling hole 37 of the corresponding locking rod.

The locking bar preferably has a mainly triangular shape with rounded triangle ends, one triangle end mainly concentrically surrounding said revolving spindle 44, whereas another triangle end mainly concentrically surrounds the other joint, e.g. the spindle pin mounted on the other main side. Side 65, which connects said two triangle ends to each other, is fairly straight, whereas the other triangle side 66, originating from revolving spindle 44, suitably is bent outwards. The third triangle side includes a preferably U-shaped hook 67, a claw 60 being formed as a triangle point and a concentric rounding of the locking bar, which extends around the greater portion of the revolving spindle, i.e. about 200°.

Connecting link 43 can be half the thickness of the locking bar, since there is no risk, that e.g. during a burglary it is subjected to the same large stresses as the locking bar. The basic shape preferably is plate-like and between the two joints the link preferably is goose-necked to form two parts mutually displaced in parallel, joint 46 ending up in the centre plane of the locking bar. The portion with the last-mentioned joint has a hammer-like narrow shape, whereas the other link portion, starting from the other joint, will be continuously wider to optimize the guidance in house 3, a cavity 68 on the other side of the first joint allowing a pivoting of the link around the outer edge of web 18.

Figure 4:
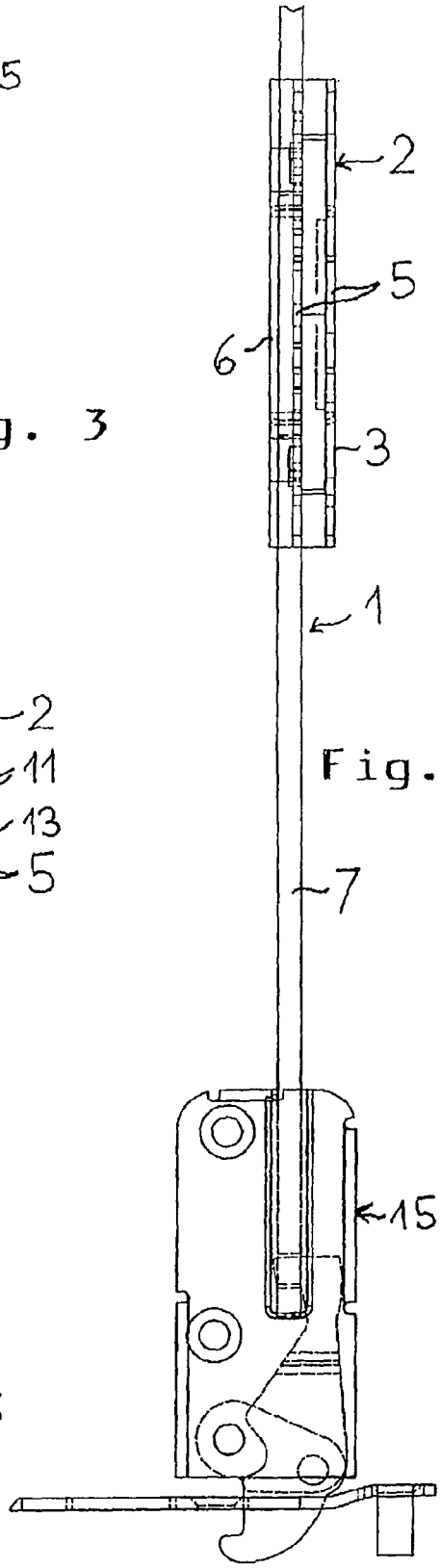
FIG. 4 a planar view of the spagnolet according to FIG. 3 with an adjusting mechanism, a locking rod, a frame lock and a locking plate according to the invention.
Figure 5:
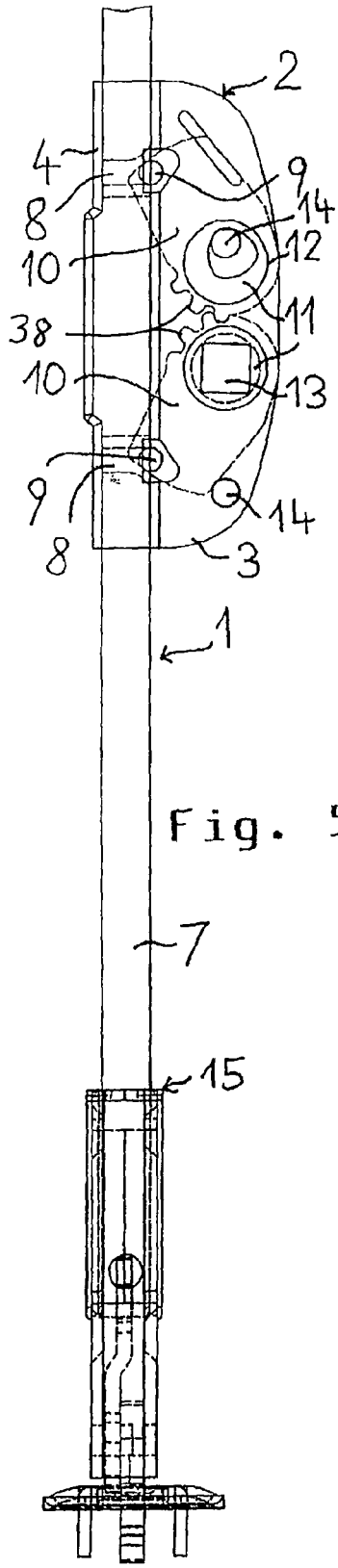
FIG. 5 a view from the right of the assembly according to FIG. 4.
Figure 9A:
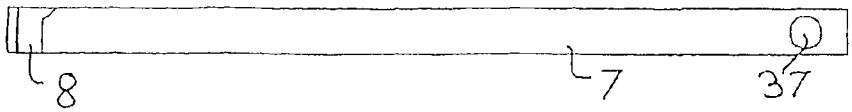
FIG. 9 a planar view and a side view of a locking rod according to the invention.
Figure 9B:
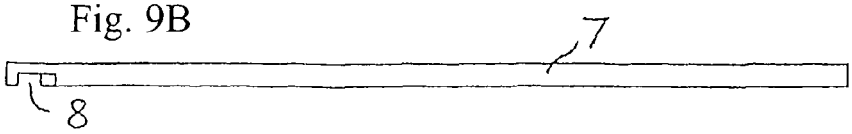
Figure 10F:
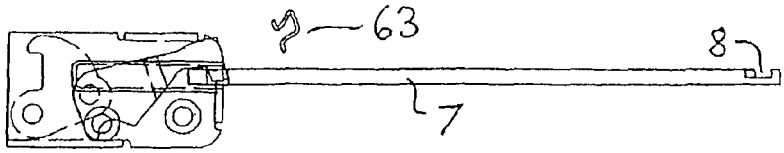
FIG. 10 sequential views of the assembling of a frame lock according to the invention.
Figure 10E:
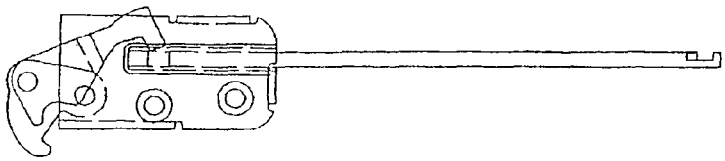
Figure 10D:
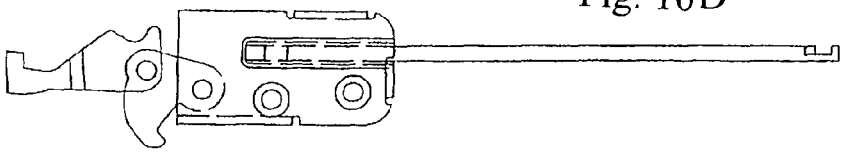
Figure 10C:
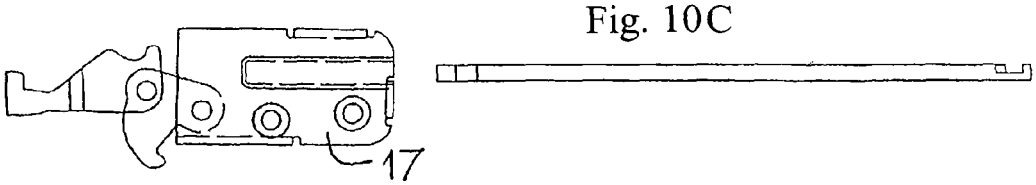
Figure 10B:
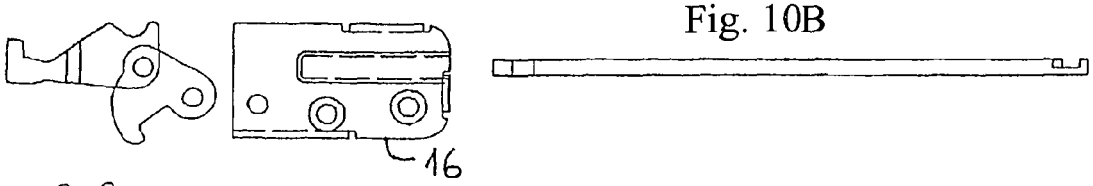
Figure 10A:
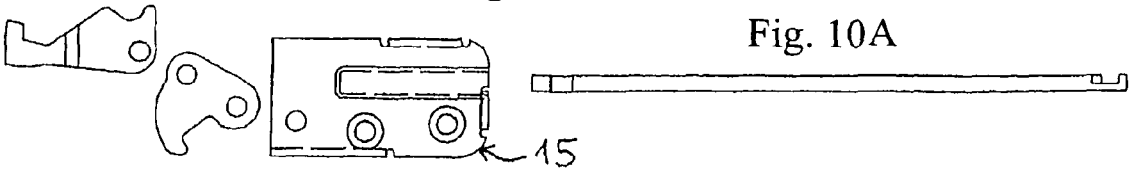

An arbitrary locking plate 49 can be used for the locking itself in a frame recess 48. It will be fastened, with screws (not shown), in the frame wood or the like. However, it is particularly advantageous to use a special locking plate according to the invention, which is shown in FIGS. 4 and 5. This locking plate has an enlongated parallelepipedic shape and is made of a strong bent plate. One of gable sides 51 is bevel-shaped jointly with side surfaces 50 and bottom side 69 and holds a hole 53, suitably recessed from the interior in order to easily insert a screw (not shown), which is inserted through a first locking hole 55 in upper or covering side 52, which has a locking flange 54, turned in the direction from the gable side 51 in connection with locking hole 55, for said locking bar 42. Upper side 52 has, towards the other gable side 58, a second locking hole 57, which ends immediately in front of gable side 58 to form a locking flange 59, designed to hook up the locking bar with its claw 60 in an alternative locking position. These two locking positions may be called a closing position and a ventilation position. In both positions the case and the frame cannot be pried open, since claw 60 from the rear or from the interior acts on the respective locking flange of the locking plate. Hole 57 is made by punching out material from the upper side and bending it to obtain an oblique fastening tongue 61, which is mainly parallel with the gable side and is provided with a suitably bevelled screw hole 62. The tongue is connected to the upper side on the side, which faces away from locking flange 59. A screw, not shown, is inserted into hole 57 and through screw hole 62 as well as through an e.g. oval hole 64 in the bottom side. In this way the locking plate will be fastened in the frame in a reliable way, entirely without visible screws and without screws accessible in a lateral direction. The upper side suitably will project laterally above the side surfaces and gable side 58 with a cover flange 56, in which holes, if necessary, for additional fastening screws can be made.

It is shown in FIG. 10, that on each side of the adjusting mechanism four parts are to be assembled as a unit, i.e. a locking rod, a frame locking house, a locking bar and a link. The locking bar and the link are initially joined to each other, according to FIG. 10*b*. The locking bar is then inserted into the house, the width of which is larger than the transverse extension of the locking bar and the lip of the revolving spindle but is smaller than the total transverse extension of the locking bar and the two spindle pins, which constitute the revolving spindle and the first joint for the link. This means, that only the unit, which comprises the locking bar and the link, can be inserted into the house, provided the link as a whole will stay outside the house. As soon as, according to FIG. 10*c*, said unit has been inserted into the house, the locking bar will be displaced in a lateral direction, according to FIG. 10*d*, the spindle pin then meshing with the bore in the house, designed for his purpose. Also, said locking rod with its coupling end will be pushed forward and up to the stop and into the notch embossings. Then the link, according to FIG. 10*e*, can be swung into the house, since the lateral displacement, mentioned above, has made room for the locking bar and also the pin for the first joint of the link. The link is then swung into the house completely, until its second joint is fastened in the hole of the guide hole. The locking rod is removed from the house again, according to FIG. 10*f*, the locking bar and the link following the locking rod and finally being completely withdrawn into the house. A joining, obtained in this way, can be secured by fastening a friction lock, e.g. designed as a simple U-shaped clip 63, to the locking rod adjacent the house, in order to prevent the locking rod from being pushed inwards again. When subsequently the spagnolet is inserted into a groove in the frame, then the friction lock suitably automatically engages the material, which surrounds the groove and is removed in this way. It is shown in FIGS. 10*a-e*, that the locking bar during the entire assembling process is in an end position, where the locking bar has been swung out of the house beyond the locking position, referred to, in relation to the locking plate. It is solely in this end position possible to let the link swing into and out of the house, due to the length and the position of the link in relation to the web tongues, In case the locking bar and then also the link is swung just slightly into the house, then the second end of the link ends up below the web tongues and is secured in this way against a swinging out-movement. Also in a transverse direction the locking bar and the link are secured in the house, because the inner width of the house is smaller than the total thickness of the locking bar and the two spindle pins, which project in different directions. In case it is necessary to replace a part, connected to the frame locking house, the fastening screws for the house in the frame have to be removed first and then an excessive turning can be done and the link and then the locking bar and the locking rods can be removed.

Whereas the insertion end of the locking rods in the adjusting mechanism suitably is finished by the manufacturer, their frame locking ends suitably can be cut by a user, e.g. a window factory, to a suitable length and be provided with link holes. In this way a user can buy a large amount of spagnolets with e.g. a maximum length and then be able to quickly and conveniently make them shorter according to the actual need the user has.

The invention is not limited to the embodiments described above and shown in the drawings but can be modified and supplemented in an arbitrary manner within the scope of the inventive idea and set forth in the following claims. Thus, house 16 and the other parts can of course be made according to other techniques and/or with other materials, e.g. plastic materials. The locking rods can, where appropriate, be combined with locking means, known per se, mounted along the length of the locking rods and implementing them in a lateral direction between two cases respectively. The locking bar and the link can be united, e.g. by riveting, before the mounting in the house. The locking bar can also, instead of its own stationary spindle, be provided with a straight through bore, into which a pin or the like is inserted straight through the house, to be used as a revolving spindle.

The invention claimed is:

1. A locking device for a spagnolet mechanism (1), anchored in a door or window case (39), the spagnolet mechanism (1) comprises:

a central adjusting mechanism (2);

a first locking rod (7) and a second locking rod (7) both having one end coupled to the central adjusting mechanism (2) and extending in mutually opposite directions, and each of the locking rods (7) having a respective free end;

a first frame lock (15) and a second frame lock (15) located on opposite sides of the central adjusting mechanism, substantially adjacent to a door or window frame (40), each of the first and the second frame locks (15) being separated from the central adjusting mechanism (2) by a length of the first and the second locking rods (7), and operatively connected respectively with the free end of either the first locking rod or the second locking rod (7);

each of the first frame lock (15) and the second frame lock (15) comprising:

a lock housing (16) having a first side and a second side, the free end of the locking rod (7) being connected to the frame lock (15) at the first side of the lock housing (16), the first side of the lock housing (16) being linearly aligned with and opposite from the second side of the lock housing (16) with the second side of the lock housing (16) being remote from the central adjusting mechanism (2);

a locking bolt (42), pivotable by the locking rods around a revolving spindle (44);

a connecting link (43) being pivotably connected, via a pivot joint (45), to the locking bolt (42), and the connecting link (43) being releasably connected, via a connection joint (46), to the respective locking rod, the locking bolt (42) is pivotally anchored within the lock housing (16) by said revolving spindle (44) and is displaceable into an exposed position such that the locking bolt (42) partially extends outside of the lock housing (16) from the second side of the lock housing (16), and the locking bolt (42), in an extreme pivotal position, is connectable with the connecting link (43) via the pivot joint (45) and the connecting link (43) is accommodated within the lock housing (16), the connection joint (46) is releasably connected to the free end of one of the first or the second locking rods which jointly, together with the central adjusting mechanism (2), prevents the locking bolt (42) from pivoting back to the extreme pivotal position when the locking bolt (42) is locked and partially extends outside of the lock housing (16) from the second side of the lock housing (16).

2. The locking device according to claim 1, wherein the lock housing further comprises:

a web;

a bent plate;

first and second wider main side;

first and second narrow longitudinal sides;

a plurality of web tongues;

first and second gable sides; and, a plurality of end tongues and the bent plate, has the shape of a flat elongated paralleliped, the first and the second wider main sides (17) each originate from the web (18), which extends roughly along half the length of the frame lock (18) within the first narrow longitudinal side (19), which has a first hole (20) along its remaining portion, and the second narrow longitudinal side (21) has a second hole (22) opposite said web and is closed by the bent web tongues (23) opposite the first hole (20), and the first gable side (24), adjacent said web (18), is totally open, whereas roughly half of the second gable side (25) comprises a third hole (26), adjacent said web tongues, and closed by end tongues (27), bent towards each other and originating from the main sides regarding the other half of the gable side (25), which is transformed into said narrow longitudinal sides in the form of soft roundings.

3. The locking device according to claim 2, wherein the first hole, the second hole, and the third hole (20, 22 and 26) are delimited against the respectively adjoining bent parts (18,23 and 27) by transverse notches (28, 29, 30, 31 and 32) in order to ensure that the bendings do not affect the adjacent straight sections, close to the web (18) and the first hole(20), with a connection at the same level to the web (18), the main sides are provided with straight through, partly recessed bores (33 and 34 respectively), designed to receive screws, to be anchored in the case, in that there is in the corner area between the first gable side (24) and the web (18) a straight through bearing bore (35), which three bores are mirror-symmetrically placed, the frame lock being able to be disposed in said recess with either one of the first or second wider main sides (17).

4. The locking device according to claim 3, wherein the first and second wider main sides (17) and the frame lock (15) are provided with notch embossings (36), open towards the interior of the lock housing, ending in a closed condition, extending over most of the length of the frame lock and originating from that side of the third hole (26), which is adjacent the end tongues, said notch embossings run parallel to the web tongues and are visible from outside in the form of bulgings, and they are designed to receive, in a way, which limits the insertion, the outer ends of the first and second locking rods (7), which with their narrow sides are guided in the notch embossings and in their ends, designed to be inserted into the frame lock, are provided with a coupling hole (37), which extends straight through the broad sides and which suitably is a round hole.

5. The locking device according to claim 1, wherein the revolving spindle (44) as well as the pivot joint (45) are disposed at the locking bolt (42) in the form of one-sided spindle pins, which project in mutually opposite directions, of which the first one, the pin, which constitutes the revolving spindle, meshes with the bearing bore (35) of the frame lock housing (16), whereas said pivot joint (45) of the connecting link (43), disposed within the area for one end of the link, is designed as a straight through bearing bore, designed to be mounted on the spindle tip (47) of the locking bolt (42), which constitutes a portion of said joint, and the connection joint (46) of the connecting link (43), disposed at the other end of the link, has the form of a hook, disposed straight through said bearing bore, meshes with the coupling hole (37) in the corresponding locking rod (7).

6. The locking device according to claim 1, wherein the locking bolt (42) has a triangular form with rounded triangular ends, one of the triangular ends concentrically surrounding said revolving spindle (44), whereas the other triangular end concentrically surrounds the other joint disposed on the other main side, the side (65), which connects said two triangular ends, is straight, whereas the second triangular side (66), originating from the revolving spindle (44), is bent outwards, and the third triangular side includes a U-shaped hook (67), a claw (60) as a triangular point, being formed and a concentric rounding of the locking bolt (42), which extends around most of the revolving spindle.

7. The locking device according to claim 1, wherein the connecting link (43) is only half as thick as the locking bolt (42), and a basic shape which is plate-like and between the two joints is goose-necked in order to obtain two mutually displaced portions parallel to each other, the connection joint (46) ending up in the central plane of the locking bolt (42), which joint comprises a hammer-like narrow form, whereas the link portion, which is connected to the locking bolt (42), is originating from the above-mentioned continuously wider link portion to be able to optimize the guiding in the house (3), a cavity (68) on the other side of the joint allows the link to be pivoted around the outer edge of the web (18).

8. A locking device for a spagnolet mechanism (1) anchored in a casing (39) of one of a door or a window, the locking device comprising:

a central adjusting mechanism (2);

a first frame lock and a second frame lock each of which is located remote from the other lock on opposite sides of the central adjusting mechanism;

a first locking rod (7) and a second locking rod (7) which are coupled to, operative by and extend linearly in opposite directions from the central adjusting mechanism (2) to one of the first or the second frame locks (15), each of the first and the second locking rods (7) having a free end, remote from the central adjusting mechanism (2), which enters a first side of a lock housing, and is releasably lockable within the lock housing (16) of the first and the second frame locks (15), the lock housing (16) of the first frame lock (15) is independent of and spaced from the lock housing (16) of the second frame lock (15);

a respective spindle (44) being positioned within each of the respective lock housings;

a respective locking bar (42) being pivotally fixed within each of the lock housings (16) by the respective spindle (44) and the respective locking bar (42) being pivotably coupled to a connecting link (43), via a pivot joint (45), and the connecting link (43) having a connection joint (46), the connection joint (46) being remote from the pivot joint (45), which releasably engages the free end of the respective locking rod (7) to facilitate actuation of the respective locking bar (42) when the central adjusting mechanism (2) is actuated, and the respective spindle (44) is fixed within the respective lock housing (16), such that the respective locking bar (42) is pivotable between first and second positions by actuating the central adjusting mechanism (2), the connecting link (43) and the respective locking bar (42) in the first position, being completely enclosed and retracted within the respective lock housing (16) to facilitate opening of the door or the window and the respective locking bar (42) in the second position extending partially outside a second side of the respective lock housing (16) axially away from the corresponding locking rod (7) to facilitate locking of the door or the window, the second side of the respective lock housing (16) being axially opposite the first side of the lock housing and axially remote from the central adjusting mechanism (2), and the respective locking bar (42) only pivoting about the respective spindle (44), within the respective lock housing (16), when actuated by the respective locking rod (7) and the respective connecting link (43).

9. The locking device according to claim 8, wherein each frame lock (15) has a first hole, a second hole and a third hole (20, 22 and 26) which are delimited against a respectively adjoining a first bent part, a second bent part or a third bent part (18, 23 and 27) by transverse notches (28, 29, 30, 31 and 32) to ensure that bending does not affect adjacent straight sections of the correspond frame lock (15), and main sides (17) of each frame lock (15) are provided with a first recessed bore and a second recessed bore (33 and 34 respectively) for receiving screws to be anchored in the case, a bearing bore (35) is provided in an area between a first gable side (24) and a web (18), while at least one additional bore is provided on one of the wider main sides (17).

10. The locking device according to claim 9, wherein the main sides (17) and the frame lock (15) are provided with notch embossings (36) which open toward an interior of the house and extend over a substantial length of the frame lock (15), each notch embossing (36) originates from the third hole (26) which is located adjacent end tongues, the notch embossing extends parallel to web tongues and form visible bulgings, and each of the notch embossings (36) receives a free end of the corresponding locking rod (7) and limits insertion thereof, and narrow sides of the corresponding locking rod (7) are provided with a coupling hole (37) and guided in the notch embossings (36).

11. The locking device according to claim 10, wherein the spindle (44) and the pivot joint (45) are disposed in the locking bar (42), the spindle meshes with the bearing bore (35) while the pivot joint (45), disposed adjacent one end of the connecting link (43), is designed as a straight through bearing bore for mounting on the spindle tip (47) of the locking bar (42), which constitutes a portion of the pivot joint (45), and the connection joint (46), disposed adjacent the other end of the connecting link (43) has a hooked shaped claw (60) which meshes with the coupling hole (37) in the corresponding locking rod (7).

12. The locking device according to claim 8, wherein the locking bar (42) has a substantially triangular form with rounded triangular ends, one of the triangular ends concentrically surrounding the spindle (44), the other triangular end concentrically surrounds the other joint disposed on the other main side, and a side (65) which connects said two triangular ends together is straight, the second triangular side (66), originating from the spindle (44) is bent outwards, and the third triangular side comprises a U-shaped section (67) that includes the claw (60).

13. The locking device according to claim 8, wherein the connecting link (43) is plate-like and about half as thick as the locking bar (42), the connecting link (43) has a goose-necked which is located between the two joints in order to obtain two mutually displaced portions in parallel to each other, the connection joint (46) ending up in the central plane of the locking bar which joint comprises a hammer-like narrow form, whereas the link portion, which is connected to the locking bar (42), originates from a wider link portion so as to be able to optimize the guiding in the house (3), and a cavity (68) on the other side of the joint allows the link (43) to be pivoted around an outer edge of the web (18).

14. A locking device for a spagnolet mechanism (1) that is mounted in a casing (39) of one of a door or a window, the locking device comprising:

a central adjusting mechanism (2);

first and second locking rods (7) coupling the central adjusting mechanism (2) and extending therefrom along an axis in opposite directions with respect to each other;

a first frame lock (15) and a second frame lock (15), each of the first and the second frame locks comprising a respective lock housing (16), a respective locking bar (42), a respective spindle (44) and a respective connecting link (43);

the respective lock housings (16) of the first frame lock (15) and the second frame lock (15) each being aligned along the axis such that a remote end of the first locking rod (7) is received within the respective lock housing (16) of the first frame lock (15) on a side of the lock housing (16) facing the central adjusting mechanism (2) and a remote end of the second locking rod (7) is received within the respective lock housing (16) of the second frame lock (15) on a side of the respective lock housing (16) facing the central adjusting mechanism (2);

the respective locking bars (42) of the first and the second frame locks (15) being pivotally coupled by the respective spindle (44) to the lock housing (16) of a respective one of the first and the second frame locks (15), the respective locking bars (42) of the first and the second frame locks (15) each comprising a pivot joint (45);

the respective connecting links (43) of the first and the second frame locks (15) being pivotally coupled by the respective pivot joints (45) to a respective one of the locking bars (42) of the first and the second frame locks (15), the respective connecting links (43) of the first and the second frame locks (15) each comprising a connection joint (46);

the respective connection joints (46) of the first and the second frame locks (15) each being releasably engagable with the remote end of a respective one of the first and the second locking rods (7) such that actuating the central adjusting mechanism (2) simultaneously biases the first and the second locking rods (7) along the axis and pivots the connecting links (43) and the locking bars (42) of the respective one of the first and the second frame locks (15) between locked and unlocked positions;

each of the respective connecting links (43) and the respective locking bars (42) of the first and the second frame locks (15) being fully accommodated within the lock housing (16) of the respective one of the first and the second frame locks (15) when in the unlocked position; and each of the respective locking bars (42), when in the locked position, extending from a side of the lock housing (16) of the respective one of the first and the second frame locks (15) opposite from the central adjusting mechanism (2) such that each of the respective locking bars (42) being received in a respective a frame (40) of the door or the window, and the frames being located along the axis on opposite sides of the casing (39).

15. The locking device according to claim 14, wherein each of the first and the second locking rods (7) is a discrete element and ends of the first and the second locking rods (7), that are opposite the remote ends, are received within a channel in the central adjusting mechanism (2), the channel is linearly aligned with the first and the second locking rods (7) along the axis.

* * * * *